US005682655A

United States Patent [19]

Yoshioka

[11] Patent Number: 5,682,655

[45] Date of Patent: Nov. 4, 1997

[54] METHOD FOR PRODUCING FURRED THREADS

[75] Inventor: Yukio Yoshioka, Tone-machi, Japan

[73] Assignee: Kabushiki-Kaisha Rozason, Ibaraki-ken, Japan

[21] Appl. No.: 605,425

[22] Filed: Feb. 22, 1996

[30] Foreign Application Priority Data

Nov. 20, 1995 [JP] Japan ..... 7-13236 U
Nov. 24, 1995 [JP] Japan ..... 7-329648

[51] Int. Cl.[6] ..... C14B 15/00; D02G 3/02; D06B 69/22

[52] U.S. Cl. ..... 28/144; 57/260

[58] Field of Search ..... 28/144, 100; 57/31, 57/32, 259, 260; 69/22

[56] References Cited

U.S. PATENT DOCUMENTS

| | | | |
|---|---|---|---|
| 4,422,285 | 12/1983 | Rol | 57/200 |
| 4,606,182 | 8/1986 | Krehm et al. | 57/200 |
| 4,637,206 | 1/1987 | Suwa | 57/31 |
| 5,440,793 | 8/1995 | Yoshioka | 28/100 |

*Primary Examiner*—Andy Falik
*Attorney, Agent, or Firm*—Lowe, Price, LeBlanc & Becker

[57] ABSTRACT

A furred thread is produced by a sequence of steps, which include impregnating a fur material with moisture. The material is stretched in a stream direction of hairs of the material and dried. The material is cut in the stream direction of the hair to produce a fur strip, which is impregnated with moisture, twisted in a manner such that its hair side appears outwardly while the strip is stretched in its longitudinal direction, and dried to produce the furred thread.

2 Claims, 8 Drawing Sheets

METHOD FOR PRODUCING FURRED THREADS

BACKGROUND OF THE INVENTION

1. Field of the Invention

The present invention relates to a method for producing furred threads and also to fur products made of the furred threads, for example such as fur overcoats, fur shawls and like fur products.

2. Description of the Prior Art

The furred thread, which is a strip of fur having been twisted, is already known and used as one of materials for producing fur products such as fur overcoats, fur shawls and the like. In use, the furred threads are interlaced (i.e., knitted) with other fibers or sewn to cloths to produce the fur products.

Since less fur is used in a fur product made of the furred threads than is required for a fur product made of fur itself, the fur product made of the furred threads is low in manufacturing cost, light in weight and more flexible. Consequently, the fur product using the furred thread is very comfortable. Further, since hairs of fur in the furred thread appears in the entire outer peripheral surface of the thread, it is possible to produce a fur product which has its outer and inner sides coated with the hairs of fur.

In order to improve the fur product in weight and flexibility, it is necessary to reduce the furred thread in diameter. On the other hand, in order to produce such a thin or small-diameter furred thread, it is necessary to use a thin fur strip. However, even a skilled worker can not produce a thin fur strip having a width of less than about 3 mm. Even if a stripping machine is used to produce such a thin fur strip, the thus produced thin fur strip is poor in tensile strength. Due to such poor tensile strength, the thin fur strip often breaks during its twisting operation for producing the furred thread, or impairs in durability the fur product made of the furred threads thus produced.

Also discussed heretofore is a method for producing fur products by knitting the conventional furred threads each of which has a diameter of from 5 to 8 mm. Consequently, the conventional furred thread is too large in diameter, and, therefore causes a great deal of trouble when knitted by a knitting machine. In other words, the conventional furred threads must be hand-knitted, and, therefore require a large amount of man power, make the manufacturing process of the fur products complicated and further make it very difficult to produce the fur products in large quantities.

SUMMARY OF THE INVENTION

It is an object of the present invention to provide a method for producing furred threads the furred thread being smaller in diameter, lighter in weight and more flexible than the conventional one, which makes it possible to machine-knit such small-diameter or thin furred threads and also makes it possible to provide the fur products made of the thin furred threads at low cost.

According to a first aspect of the present invention, the above object of the present invention is accomplished by a method for producing a furred thread, which includes steps of:

impregnating a fur material with moisture;

stretching the impregnated fur material in a stream direction of hairs of the fur material;

drying the stretched fur material;

cutting the dried fur material in the stream direction of the hair of the fur material to produce a fur strip;

impregnating the fur strip with moisture;

twisting the fur strip in a manner such that its hair side appears outwardly while the fur strip is stretched in its longitudinal direction; and drying the twisted and stretched fur strip to produce the furred thread.

According to a second aspect of the present invention, the above object of the present invention is accomplished by a method for producing a furred thread, which includes steps of:

(a) widening a rectangular-shaped fur material in width by stretching the fur material in a direction perpendicular to a stream direction of hairs of the fur material, the fur material having been impregnated with moisture before the stretching and being dried after the stretching;

(b) joining a plurality of the widened fur materials together by sewing them together so as to have them aligned with each other in series in the stream direction of the hairs to produce an elongated fur material;

(c) cutting the elongated fur material in the stream direction at predetermined width intervals except its opposite upper and lower end portions each of which has a predetermined length to form a plurality of longitudinal parallel cuts, the upper and lower end portions being sewn up together in a condition in which the upper and lower end portions are longitudinally offset from each other by the amount of a length equal to the width interval so that an annular fur material is produced to enable the upper and lower end portions to be longitudinally cut by longitudinally extending the longitudinal parallel cuts, whereby an elongated fur strip is produced; and (d) twisting the fur strip in a manner such that the hair side of the fur strip appears outwardly while the fur strip is longitudinally stretched after the fur strip is impregnated with moisture, the twisted fur strip being then dried to produce the furred thread.

Further, a fur product of the present invention may be produced by knitting furred threads each of which is produced by:

impregnating a fur material with moisture;

stretching the impregnated fur material in a stream direction of hairs of the fur material;

drying the stretched fur material;

cutting the dried fur material in the stream direction of the hair of the fur material to produce a fur strip;

impregnating the fur strip with moisture;

twisting the fur strip in a manner such that its hair side appears outward while the fur strip is stretched in its longitudinal direction; and drying the twisted and stretched fur strip to produce the furred thread.

BRIEF DESCRIPTION OF THE DRAWINGS

FIG. 9(*b*) is a plan view of the fur strip, illustrating the stretching step in operation of the strip;

FIG. 9(*c*) is a plan view of the furred thread thus prepared;

FIG. 9(*d*) is a plan view of the furred thread wound round a spool;

DESCRIPTION OF THE PREFERRED EMBODIMENTS

Hereinbelow, the present invention will be described in detail with reference to the accompanying drawings.

First, an embodiment of a method of the present invention for producing furred threads will described in stepwise with reference to FIGS. 1 to 9(*d*).

Figures 1A, 1B, 1C, 1D:
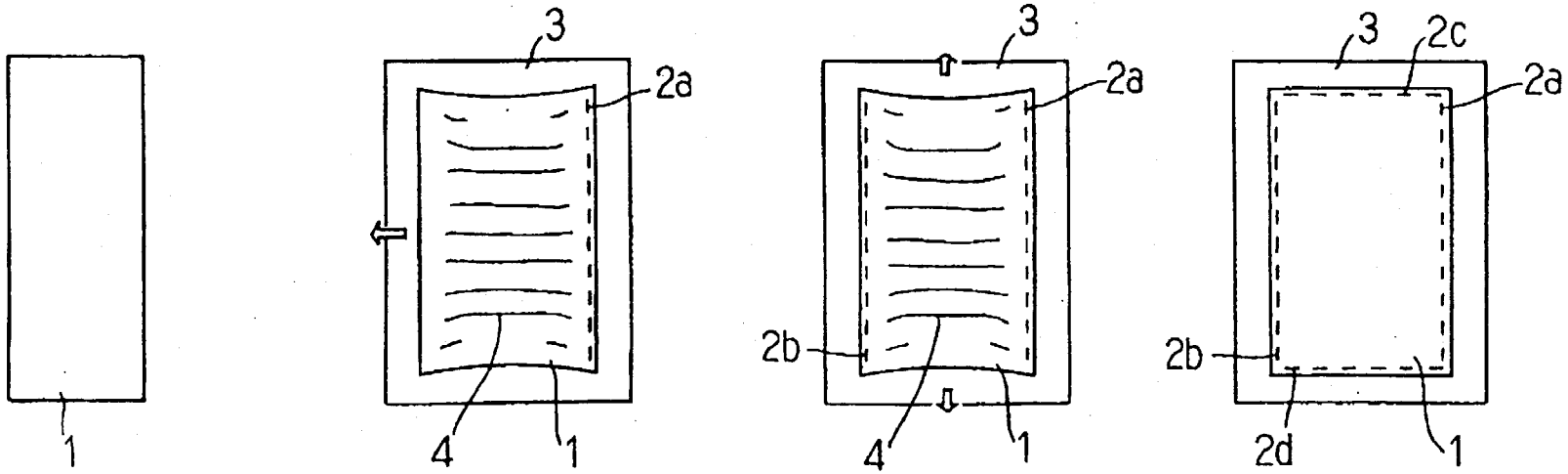
FIGS. 1(*a*) to 1(*d*) are plan views of the fur material, sequentially illustrating the fur material in its width widening operation in an embodiment of the method of the present invention.
Figure 2:
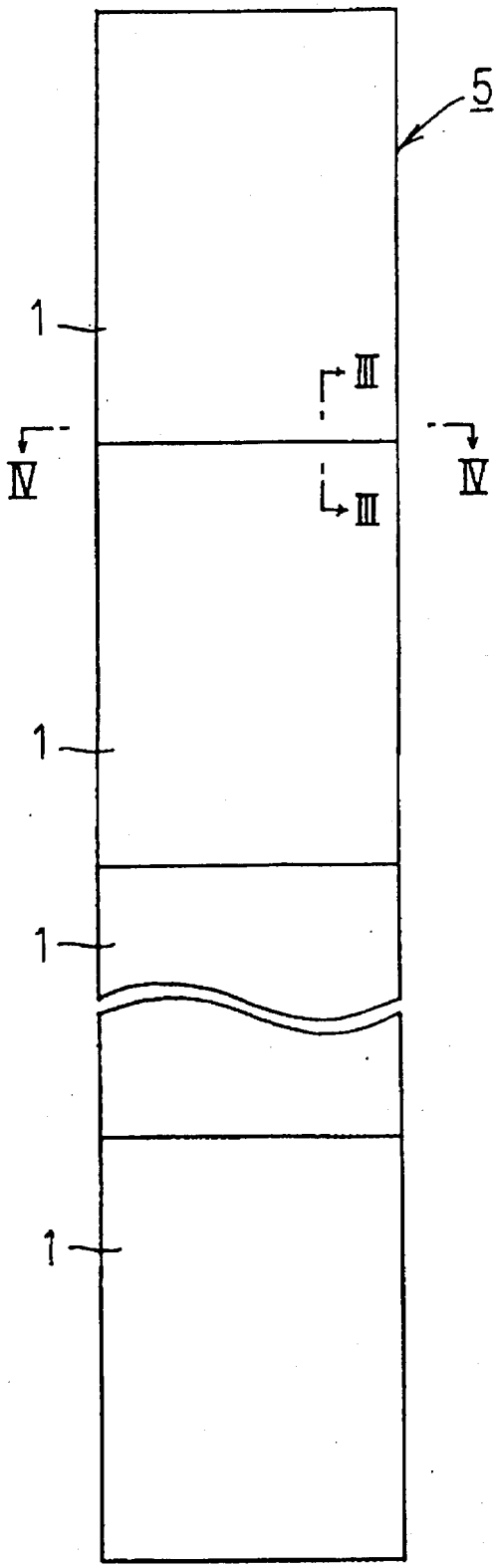
FIG. 2 is a plan view of an elongated fur material produced by joining a plurality of the fur materials together in series.

Incidentally, in FIGS. 1 and 2, and also in FIGS. 5 to 8, hairs of a fur material will be omitted for perspicuity in illustration.

A: WIDTH WIDENING STEP IN OPERATION

As shown in FIG. 1(*a*), a rectangular-shaped fur material 1 is sprayed with water, and impregnated with moisture while kept in moisture for a period of about 30 minutes.

Then, as shown in FIG. 1(*b*), the fur material 1 thus moisturized and softened has one (i.e., a right-hand one as viewed in the drawings) of its opposite long sides fastened to a workbench 3 through fasteners such as staples 2*a* and the like. The long sides of the fur material 1 are parallel to a stream direction of hairs of the material 1. The workbench 3 is made of a suitable material, for example such as wood and the like. In the above condition, the other one (i.e., a left-hand one as viewed in the drawings) of the long sides of the fur material 1 is pulled leftward to widen the fur material 1 in its width, as shown in FIG. 1(*b*).

After completion of width widening of the fur material 1 as described above, the left-hand one of the long sides of the fur material 1 is also fastened to the workbench 3 by means of the staples 2*b* and like fasteners. At this time, since a transverse wrinkle 4 is formed in the fur material 1 due to its width widening operation, it is necessary for the fur material 1 to be pulled also in a direction parallel to its long sides, as shown in FIG. 1(*c*), so as to prevent the wrinkle 4 from being formed in the fur material 1.

In a condition in which the wrinkle 4 is removed from the fur material 1, opposite short sides (i.e., both an upper and a lower side of the fur material 1) are fixed to the workbench 3 through the staples 2*c*, 2*d*. Then, the fur material 1 is kept stationary while subjected to natural drying, as shown in FIG. 1(*d*).

As described above, through the width widening operation, the fur material 1 is widened in width while shortened in longitudinal length. For example, in case that the fur material 1 is a piece of mink assuming a rectangular shape 15 cm in width and 50 cm in length, after completion of the width widening operation thereof, the fur material 1 is widened in width by approximately 20 per cent to reach approximately 18 cm in width while shortened in length by approximately 20 per cent to reach approximately 40 cm in length.

Since the fur material 1 assumes the rectangular shape, the above operation is easily conducted. Further, in the above operation, the fur material 1 is temporarily moisturized, and, thereafter subjected to natural drying. As a result, the fur material 1 having been subjected to the above operation becomes slightly harder than one not subjected thereto, which facilitates cutting of the fur material 1 into strips.

B: JOINING STEP IN OPERATION

After completion of the drying process of the fur material 1 which has all its four sides fixed to the workbench 3 in the above width widening operation, all the staples 2*a*, 2*b*, 2*c*, 2*d* are removed from the fur material 1. A plurality of the thus prepared fur materials 1 are longitudinally aligned in series with each other so that they have their opposite short sides, i.e., their upper and lower sides, adjacent to each other. Then, these adjacent sides are joined together by sewing them together to produce an elongated fur material 5, as shown in FIG. 2.

For example, the number of the fur materials 1 thus sewn together in the above is within a range of about 10 to about 13 pieces in order to obtain a sufficient amount of furred threads for making a short coat, provided that the furred threads are made of the fur materials 1, i.e., the piece of mink assuming the above-mentioned rectangular shape 15 cm in width and 50 cm in length.

Figure 3:
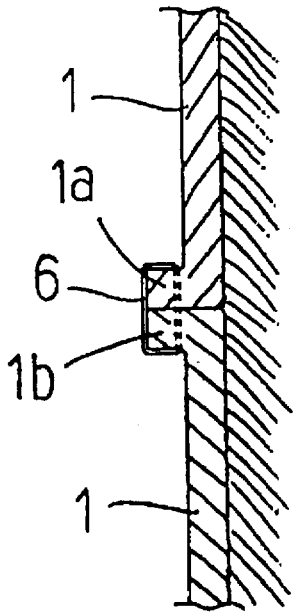
FIG. 3 is an enlarged longitudinal sectional view of the elongated fur material, taken along the line 111—111 of FIG. 2.
Figure 4:
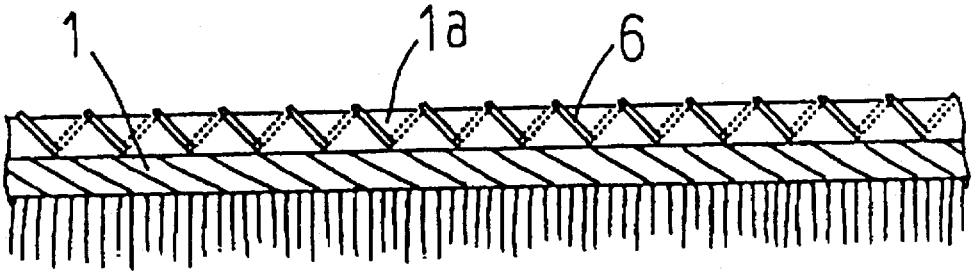
FIG. 4 is a an enlarged cross-sectional view of the elongated fur material, taken along the line IV—IV of FIG. 2.

As shown in FIGS. 3 and 4, sewing up of the fur materials 1 is conducted in a manner such that: each of adjacent ones of the fur materials 1 to be sewn up together has each of its opposite short sides bent rearward to form each of adjacent seam margins 1*a*, 1*b*; and, these seam margins 1*a*, 1*b* are sewn up with a sewing thread 6 in a manner such that the thread 6 is wound round these seam margins 1*a*, 1*b*.

C: STRIP CUTTING STEP IN OPERATION

Figure 5:
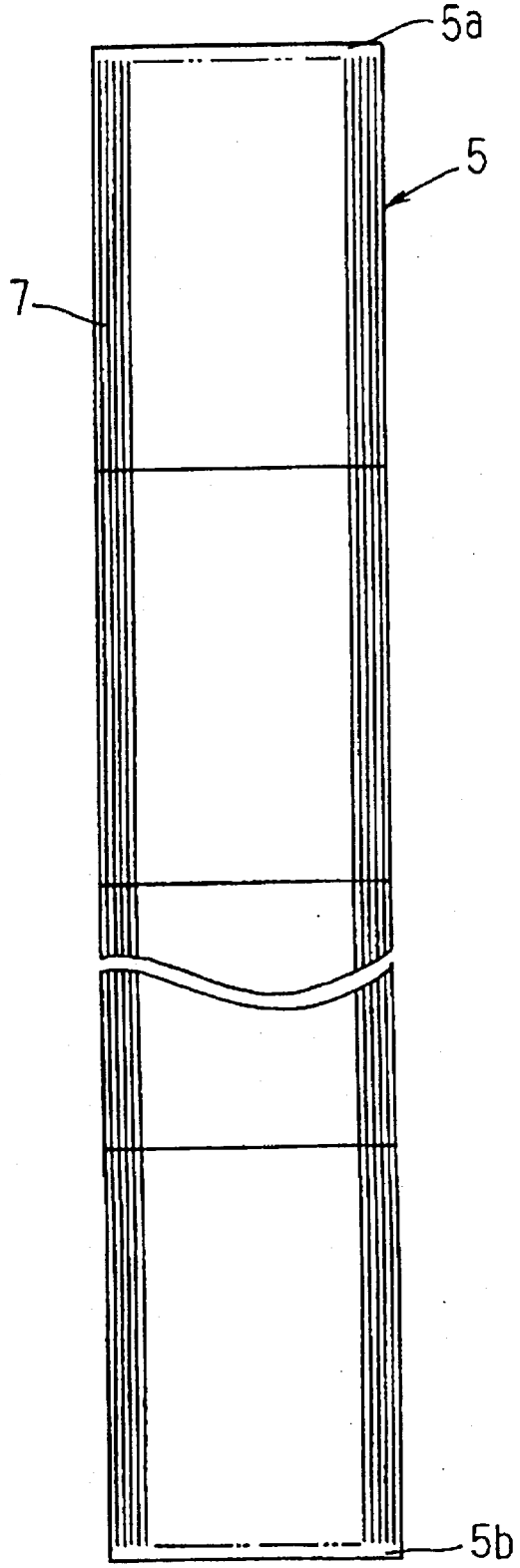
FIG. 5 is a plan view of the elongated fur material provided with a plurality of longitudinal parallel cuts.

As shown in FIG. 5, the elongated fur material 5 is longitudinally cut at width intervals of about 3 mm except its opposite upper and lower end portions 5*a*, 5*b* to form a plurality of longitudinal parallel cuts 7. Each of the upper and lower end portions thus remaining uncut has a length of about 1 cm.

Figure 6:
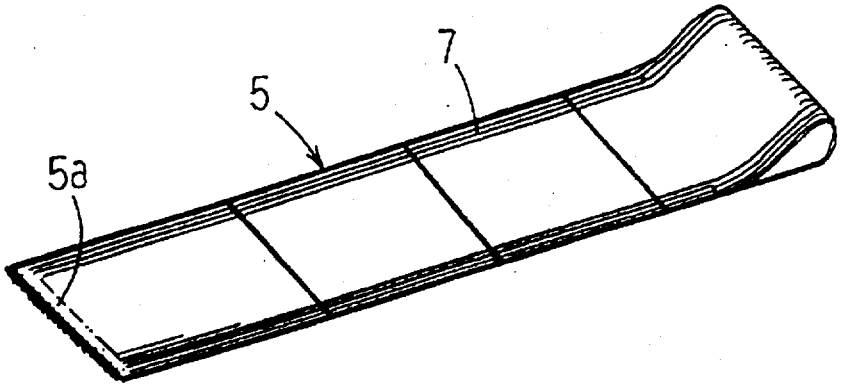
FIG. 6 is a perspective view of an annular fur material produced by sewing opposite upper and lower ends of the elongated fur material together.
Figure 7:
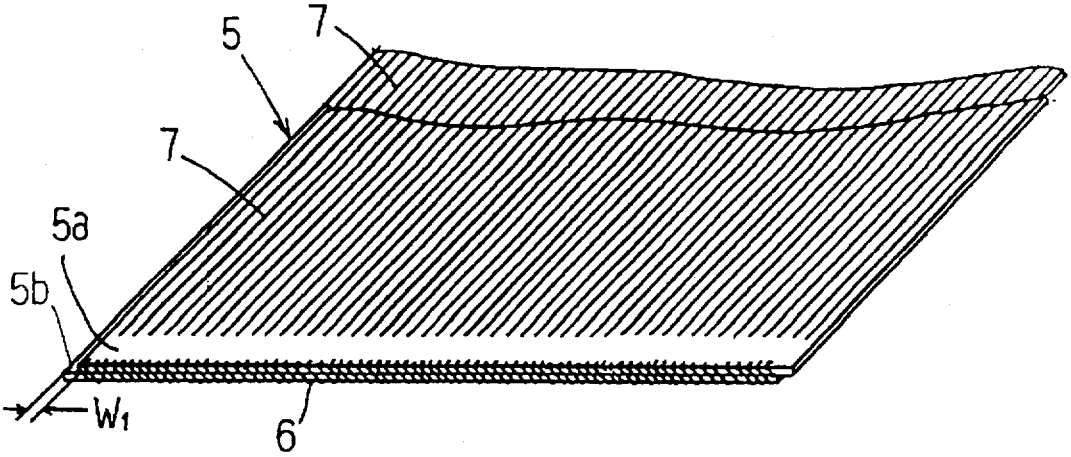
FIG. 7 is an enlarged perspective view of a stitching portion of the annular fur material.
Figure 8:
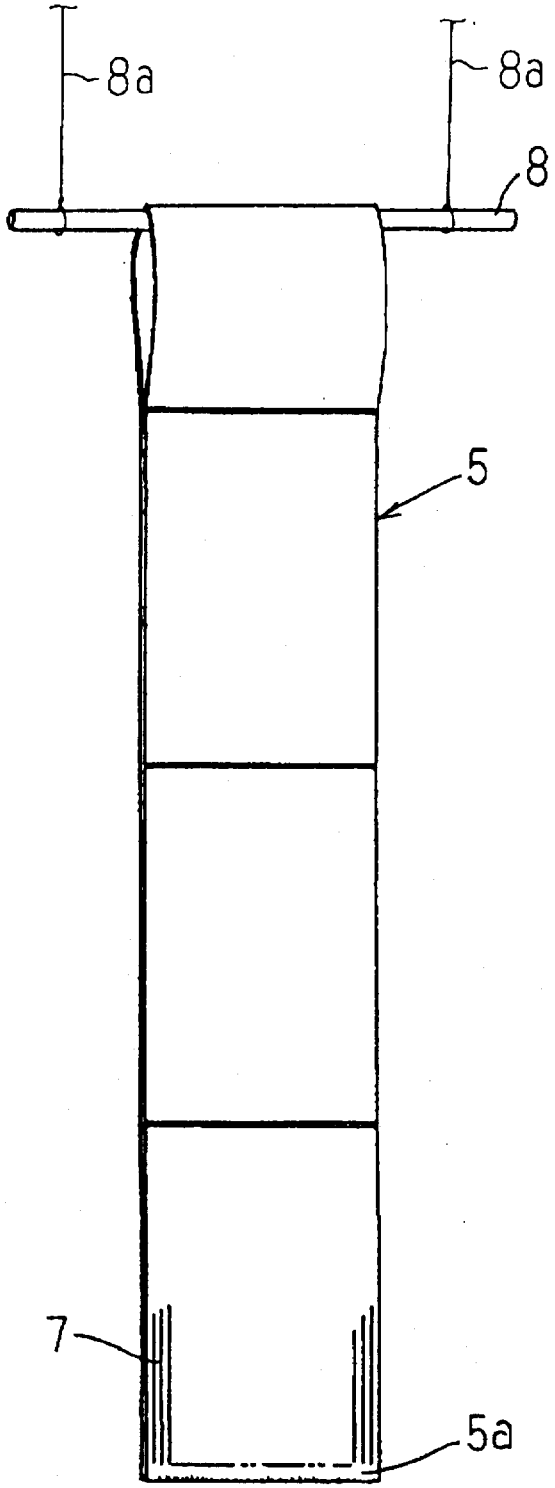
FIG. 8 is a perspective view of the annular fur material suspended from a bar.

As shown in FIGS. 6 and 7, the elongated fur material 5 thus cut is then folded in half in a manner such that the hair side of the fur material 5 is disposed inside the folded material 5 so as to have the upper and lower end portions 5*a*, 5*b* of the material 5 be adjacent to each other. After that, these end portions 5*a*, 5*b* of the fur material 5 thus folded are sewn together with the sewing thread 6 in the same manner as that described in the above joining step, i.e., in a manner such that the thread 6 is wound round these end portions 5*a*, 5*b*, whereby the fur material 5 assumes an annular shape shown in FIG. 8. In this sewing operation of the end portions 5a, 5b of the fur material 5, as is clear from FIG. 7, these end portions 5a, 5b are longitudinally offset from each other, i.e., out of alignment with each other to produce a difference W1 in length therebetween. In this embodiment of the present invention, the difference W1 is equal in length to the above-mentioned width interval of about 3 mm. The thus offset end portions 5a, 5b are then sewn up together to produce the annular fur material 5.

After that, the thus prepared annular fur material 5 is suspended from a bar 8 so as to have the end portions 5a, 5b of the material 5 disposed at the lowermost point of the material 5. Then, the end portions 5a, 5b of the fur material 5 are longitudinally cut by longitudinally extending the plurality of the cuts 7, so that the annular fur material 5 is formed into an elongated fur strip 9 having been spirally wound round the bar 8. The fur strip 9 is shown in FIGS. 9(a).

D: TWISTING STEP IN OPERATION

Figure 9A:
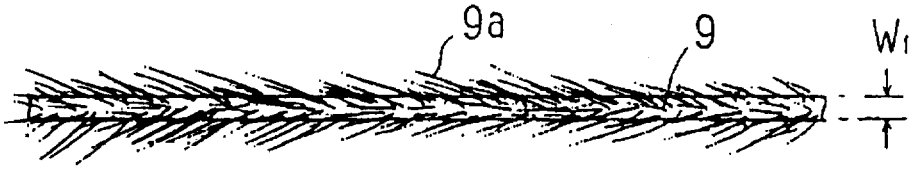
FIG. 9(*a*) is a plan view of the fur strip, illustrating the twisting step in operation of the strip.

Then, as shown in FIG. 9(a), the fur strip 9 thus formed is moisturized with water, and therefore softened in texture. In this moisturizing operation: water is retained in a water-holding object such as sponges, sponge-like objects and the like; and, the flesh side (i.e., hairless side) of the fur strip 9 is brought into contact with an upper surface of the water-holding object so as to moisturize the fur strip 9, which prevents hairs 9a of the fur strip 9 from being moisturized. Consequently, it is possible to prevent the hairs 9a from being wrapped in the fur strip 9 when the strip 9 is subjected to the twisting operation thereof. Preferably, a softening agent, for example such as amino-silicon modifications and the like is added to the water with which the fur strip 9 is moisturized or impregnated. Even when the fur strip 9 is a fat one, i.e., a hard one to moisturize with water, the softening agent added to water makes it possible to have the fur strip 9 impregnated with the water thus softened. The fur strip 9 impregnated with the water becomes more flexible, which facilitates twisting operation of the fur strip 9.

Figure 9B:
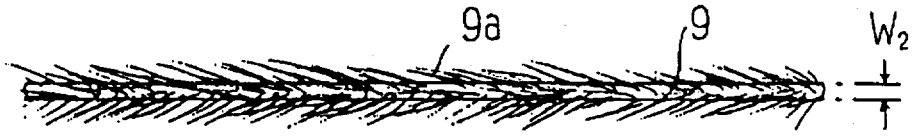

After the fur strip 9 is impregnated with the water and becomes more flexible, the fur strip 9 is longitudinally stretched, as shown in FIG. 9(b), so that the fur tissue of the strip 9 having been stretched widthwise in the above width widening operation returns to its initial condition, whereby the fur strip 9 is shortened in width while extended in its longitudinal direction. At this time, since the longitudinal direction of the fur strip 9 is the same as that of the tissue fibers of the fur strip 9, it is possible for the fur strip 9 to have a sufficient tensile strength. In case that the fur strip 9 is made of mink and has an initial width W1 of 3 mm, one 9 having been longitudinally stretched has a width W2 of about 2 mm and has its length extended by the amount of about 30 per cent.

Figure 9C:
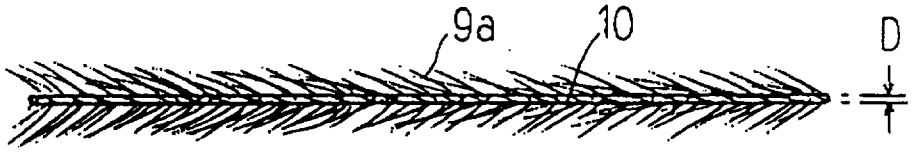

In twisting operation, the fur strip 9 is longitudinally stretched while twisted in a manner such that the hairs 9a of the fur strip 9 appear outward to produce a furred thread 10 having a diameter D of up to 3 mm, as shown in FIG. 9(c). The reason why the furred thread 10 has the diameter D of up to 3 mm is that a knitting machine can not knit the furred thread having a diameter of more than 3 mm. When the fur strip 9 has the width W1 of 3 mm as is in this embodiment of the present invention, it is possible to produce the furred thread 10 having a diameter D of about 1 mm.

Figure 9D:
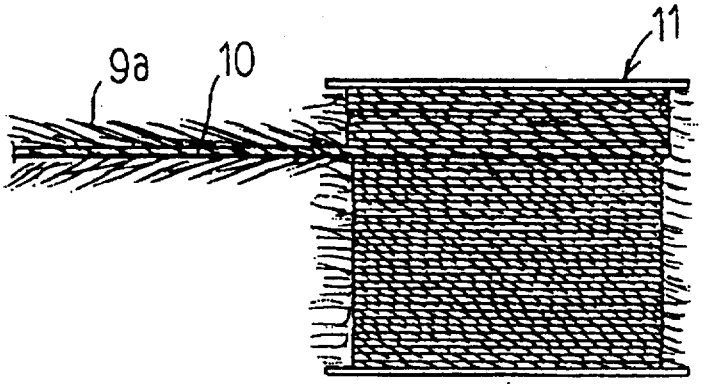

The furred thread 10 thus twisted is then wound round a spool 11, and dried so as to have its twisted form fixed, as shown in FIG. 9(d).

Figure 10:
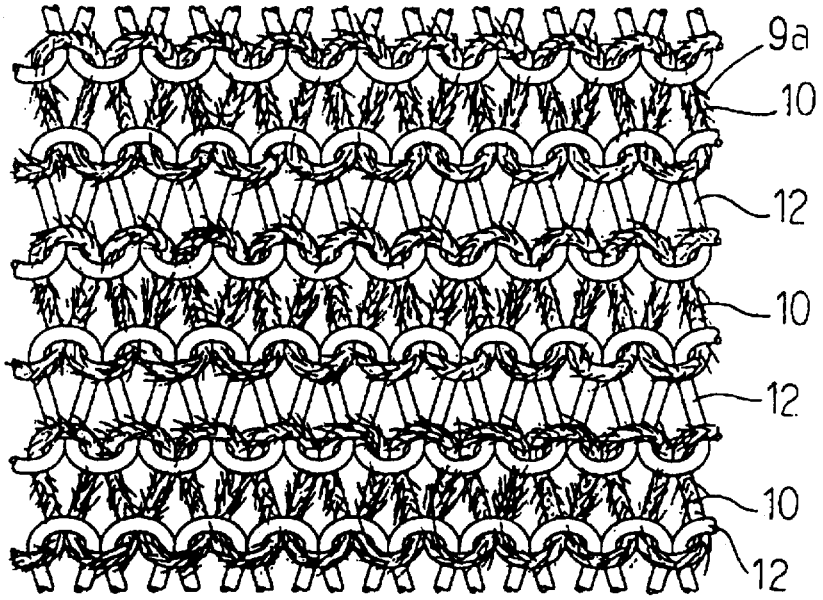
FIG. 10 is an enlarged plan view of the furred threads having been knitted together with woolen yarns in a manner such that the furred threads are spaced alternately with the woolen yarns in a stitch pattern of the fur product, illustrating the stitch pattern.
Figure 11:
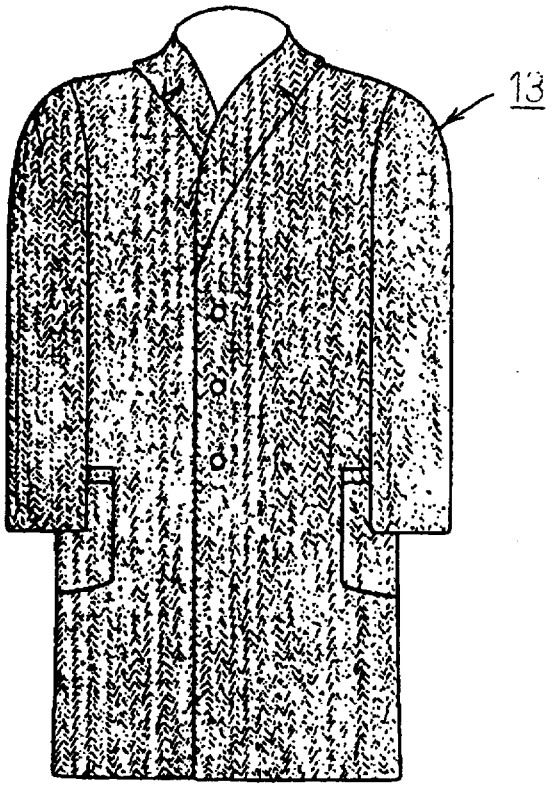
FIG. 11 is a front view of an example of the fur product of the present invention.

For example, as shown in FIG. 10, the furred threads 10 having the above construction are knitted with other threads such as woolen yarns 12 and the like to produce a fur product, for example such as an overcoat 13 (shown in FIG. 11), shawls and the like. On the other hand, FIG. 10 shows an enlarged portion of the fur product of the present invention, illustrating a stitch pattern of the fur product in which the hairs 9a of the furred threads 10 are shown as short ones in order to clearly show the stitch pattern. In case that the fur product is of mink, the hairs 9a of the fur product are thick in growth and long in length to have a length of from 3 to 5 cm, which enables the hairs 9a to completely hide the stitch pattern of the fur product thereunder. Further, it is also possible to knit the fur product only with the furred threads 10. In this case, the hairs 9a of the fur product thus produced becomes thicker, which improves the fur product in quality.

Since the method of the present invention for producing the furred threads has the above construction, it is possible to obtain the following effects:

In the method of the present invention, in a condition in which the tissue of the fur material 1 is deformed widthwise by stretching the material 1 widthwise, the fur material 1 is longitudinally cut to produce the fur strips 9. The strip 9 is longitudinally stretched during its twisting operation so as to have its tissue return to its initial condition, which enables the thus stretched fur strip 9 to have its width less than that of one still not stretched. Consequently, it is possible for the method of the present invention to easily produce the fur strip 9 which is thinner in width than the conventional one.

As a result, the furred thread 10 constructed of such thinner fur thread 9 is thinner or smaller in diameter, lighter in weight and more flexible than the conventional one.

Further, in production of the furred thread 10 of the present invention, since the fur material 1 is longitudinally cut in parallel with a stream direction of the hairs of the fur material 1, it is possible to align the longitudinal direction of the furred thread 10 with a stream direction of the tissue fibers of the fur material 1, which enables the furred thread 10 of the present invention to obtain a sufficient tensile strength, and therefore to be improved in durability.

Still further, since it is possible for the method of the present invention to produce the small-diameter furred thread 10 which is machine-knitted, it is possible to produce the fur products on a large-scale basis, which reduces the manufacturing costs of the fur products.

Further, since the fur product of the present invention is knitted with the small-diameter furred threads 10, the fur product of the present invention is excellent in flexibility. In case that fur garments such as overcoats and the like are knitted with the furred threads 10 of the present invention, they are lightweight and soft in texture, and therefore very comfortable.

In addition, when the furred threads 10 of the present invention are knitted with other threads such as woolen yarns and the like, it is possible to drastically reduce the amount of fur required to produce the fur product in comparison with the fur product knitted with the furred threads 10 only, and to provide a lighter and more flexible fur product at low cost.

What is claimed is:

1. A method for producing a furred thread, comprising the steps of:

(a) widening a rectangular-shaped fur material in width by stretching said fur material in a direction perpendicular to a stream direction of hairs of said fur material, said fur material having been impregnated with moisture before said stretching and being dried after said stretching;

(b) joining a plurality of said widened fur materials together by sewing them together so as to have them aligned with each other in series in said stream direction of said hairs to produce an elongated fur material;

(c) cutting said elongated fur material in said stream direction at predetermined width intervals except at opposite upper and lower end portions thereof each of which has a predetermined length to form a plurality of longitudinal parallel cuts, (i) producing an annular fur material by sewing said upper and lower end portions together such that said upper and lower end portions are longitudinally offset from each other by a length equal to said width interval, and (ii) cutting said upper and lower end portions to produce an elongated fur strip by longitudinally extending said longitudinal parallel cuts; and (d) twisting said fur strip in a manner such that a hair side of said fur strip appears outward while said fur strip is longitudinally stretched after said fur strip has been impregnated with moisture, said twisted fur strip being then dried to produce said furred thread.

2. The method for producing the furred thread, as set forth in claim 1, wherein:

in said twisting step (d), said fur strip is so twisted as to have a diameter of up to 3 mm.

* * * * *